US008900016B2

(12) United States Patent
Chan

(10) Patent No.: US 8,900,016 B2
(45) Date of Patent: Dec. 2, 2014

(54) USB CONNECTOR STRUCTURE

(71) Applicant: ZK-TEK Technologies Co., Ltd., New Taipei (TW)

(72) Inventor: Yi Chia Chan, New Taipei (TW)

(73) Assignee: ZK-TEK Technologies Co., Ltd., New Taipei (TW)

( * ) Notice: Subject to any disclaimer, the term of this patent is extended or adjusted under 35 U.S.C. 154(b) by 23 days.

(21) Appl. No.: 13/908,709

(22) Filed: Jun. 3, 2013

(65) Prior Publication Data

US 2014/0322986 A1 Oct. 30, 2014

(30) Foreign Application Priority Data

Apr. 24, 2013 (TW) ..... 102207506 U

(51) Int. Cl.
*H01R 24/00* (2011.01)
*H01R 24/64* (2011.01)

(52) U.S. Cl.
CPC ..... *H01R 24/64* (2013.01)
USPC ..... 439/676

(58) Field of Classification Search
CPC ..... H01R 23/025; H01R 13/6658
USPC ..... 439/676, 76.1, 79, 80, 934
See application file for complete search history.

(56) References Cited

U.S. PATENT DOCUMENTS

| | | | | |
|---|---|---|---|---|
| 5,372,524 | A * | 12/1994 | Yamada | 439/607.01 |
| 6,322,388 | B1 * | 11/2001 | Akio et al. | 439/459 |
| 7,445,504 | B1 * | 11/2008 | Zhang | 439/607.01 |
| 2003/0139095 | A1 * | 7/2003 | Yang Lee | 439/607 |
| 2005/0227537 | A1 * | 10/2005 | Peng | 439/607 |

* cited by examiner

*Primary Examiner* — Phuongchi T Nguyen
(74) *Attorney, Agent, or Firm* — Rabin & Berdo, P.C.

(57) ABSTRACT

A USB connector structure, configured with a combination structure of a base, a main structure, a plural of pins and a fixing structure, to enable said plural pins to be configured on the conducting pads without soldering process and to provide a convenient assembly by firmly hooking and fastening both the main structure and the fixing structure over the base. And, the present invention can be applied in various USB connectors or similar connecting structure.

10 Claims, 14 Drawing Sheets

USB CONNECTOR STRUCTURE

BACKGROUND OF THE INVENTION

1. Field of the Invention

The present invention relates to a USB connector structure, comprising a base, a main structure, a plural of pins and a fixing structure, wherein the main structure and the fixing structure are configured over the base and are formed as a whole body by firmly hooked with each other, and one side of those pins are configured as bending ends which extend outside of the main structure and provide electric contact with those conducting pads laid on the base correspondingly. Therefore, the present invention enables those pin applied in the USB connector structure a convenient assembly without traditional soldering procedure, and provides a more convenient and efficient method to shorten prior USB connector manufacturing process.

2. Description of Prior Art

The USB connectors had been adopted as a standard port to act as a transmission interface between the computer and external peripherals. Especially, USB connectors are popularly used in memory storage device and equipped with function of 'hot plugging' or 'plug and play'

As to the manufacturing process of the prior USB connectors, the conducting pins are soldered on the base. However, there is an earlier 'DIP-dual in-line package' job to be finished in advance. Then, the soldering process is carried out. And, there must be a soldering check to make sure those pins are soldered on the base without extra or less tin used, and the USB connector can provide a satisfied transmission test. Finally, a USB connector is produced and to be used as an interface described above.

The soldering procedure takes a considerable time consuming during the USB connector manufacturing. There are nine pins adopted in standard USB 3.0 connectors and the soldered tin might lead to an inferior conducting effect after many times plug-in and pull-out. And, it also reduces the speed of data transmission and, furthermore, data or memory is damaged and can not be retrieved.

In view of the above discussed problems, the present invention aims to provide a convenient assembly without traditional soldering procedure, and provides a firmly joint structure, a convenient and efficient method to shorten prior USB connector manufacturing process. Therefore, the prior USB connectors need to be improved.

SUMMARY OF THE INVENTION

The primary object of the present invention is to provide a USB connector structure, comprising a base, a main structure, a plural of pins and a fixing structure, wherein both the main structure and the fixing structure are configured over the base and are formed as a whole body by firmly hooked and fastened with each other, and one side of those said pins are configured as bending ends which extend outside of the main structure and provide electric contact with those conducting pads laid on the base correspondingly. Therefore, the present invention enables those pin applied in the USB connector structure a convenient assembly free from traditional soldering procedure, and provides a more convenient and efficient method to shorten prior USB connector manufacturing process.

Another object of the present invention is to provide a USB connector structure, wherein both the fixing structure and the main structure are configured as various joint combinations which enable a strong fastening assembly between each part.

And, the clipping arm is configured either in the main structure or the fixing structure to provide a fastening function with the base. Thus, the present invention provides a better and simple joint structure.

And, one more object of the present invention is to provide a USB connector structure, wherein the bottom side of the fixing structure is further configured with a step rabbet which provides a pushing effect and accommodates those pins extended outside the main structure to enable the curve part of each bending edge having a tight and better electric contact with those conducting pads laid on the base correspondingly. This joint structure can reduce transmission error or hardware damage caused by frequent plug-in and pull-out or vibration. Obviously, the present invention does not only provide a useful structural combination for the manufacturer, but also enhance the transmission function and safety for the ordinary USB interface user.

By above-mentioned description, the present invention is applicable to provide a USB connector structure with a more efficient manufacturing process and a more reliable hardware structure. Above all, the present invention is assembled free from soldering process which provides a convenient and efficient method to shorten prior USB connector manufacturing process.

The function and structure of practical embodiments can be further understood via the drawings listed below.

BRIEF DESCRIPTION OF THE DRAWINGS AND ELEMENTS

The present invention can be fully understood from the following detailed description and preferred embodiment with reference to the accompanying drawings, in which.

Figure 1:
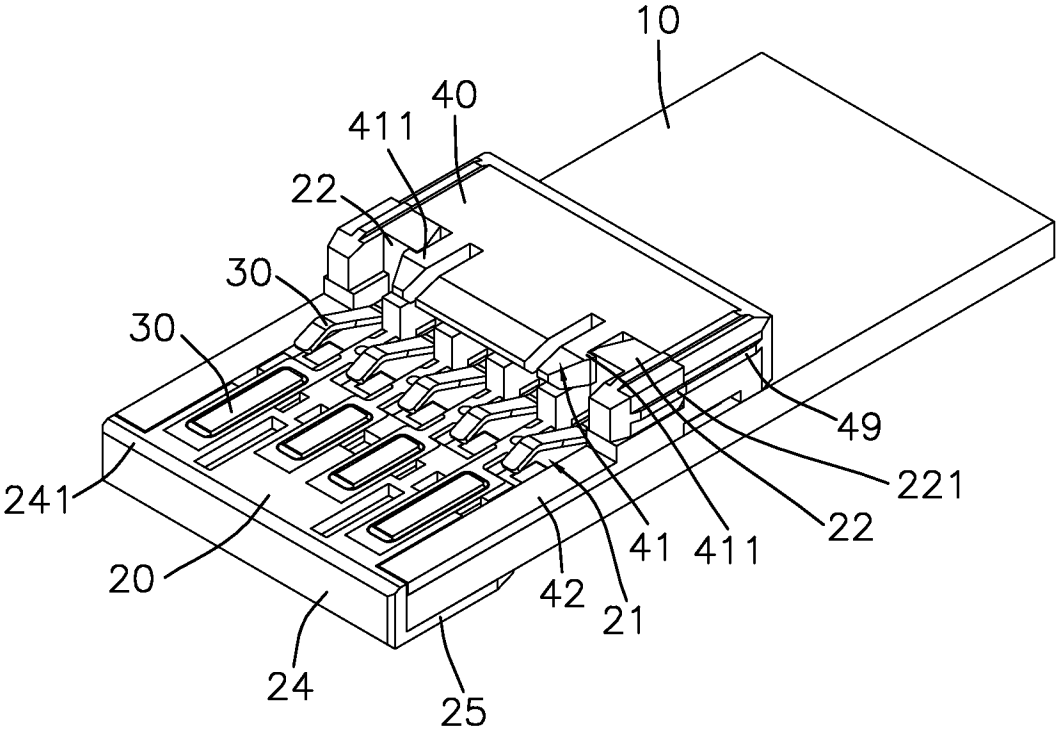
FIG. 1 illustrates a three-dimensional schematic view of the present invention.
Figure 2:
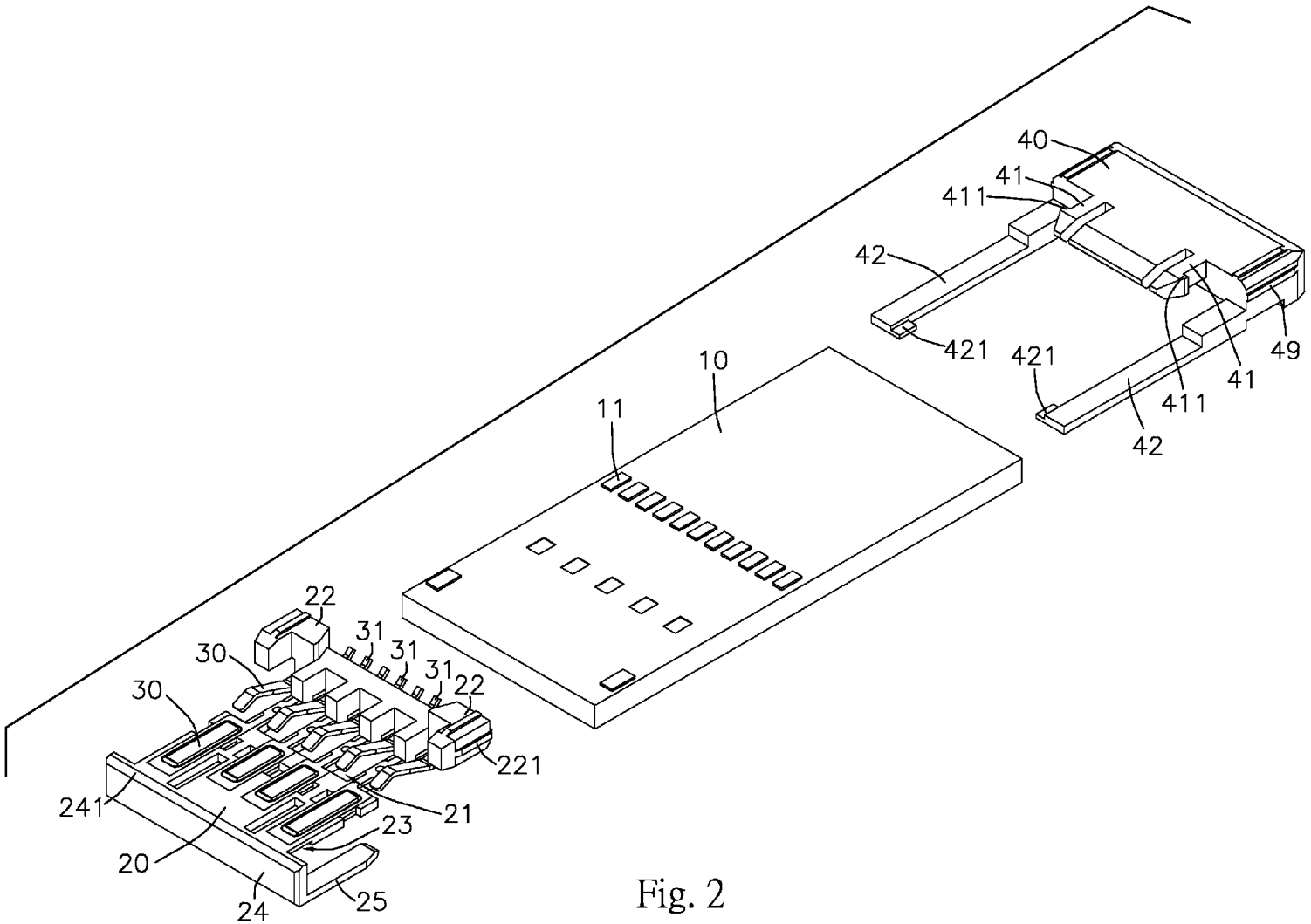
FIG. 2 illustrates a three-dimensional decomposition view of the present invention.
Figure 3:
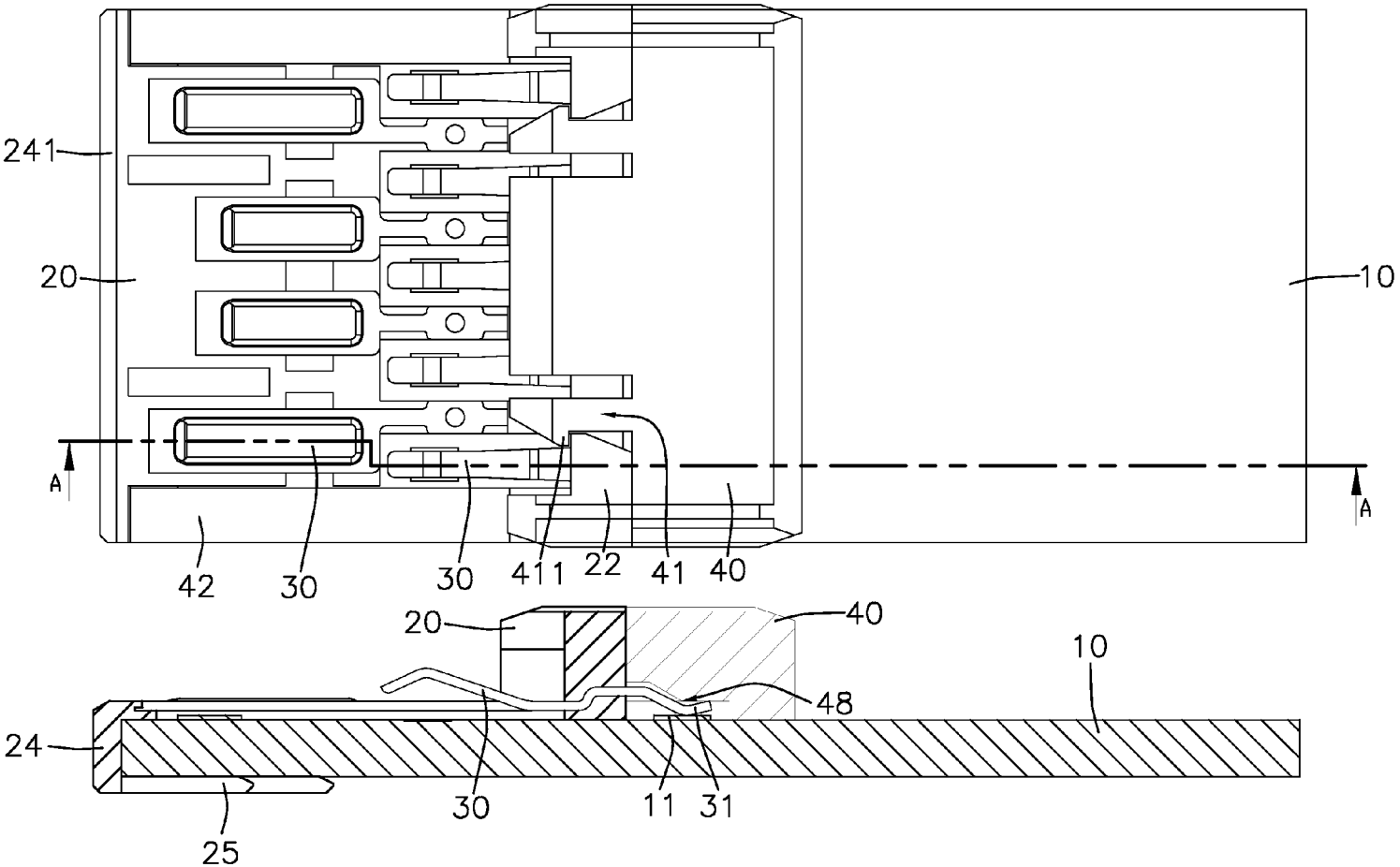
FIG. 3 illustrates an A-A schematic cross-section view of the present invention.

The elements related to the present invention are listed as follows:

| | | | |
|---|---|---|---|
| 10, | base | 11, | conducting pad |
| 20, | main structure | 21, | pin rabbet |
| 22, | holding block | 23, | side rabbet |
| 24, | front stopper | 25, | clipping arm |
| 26, | notch | 27, | rabbet |
| 30, | pin | 31, | bending end |
| 40, | fixing structure | 41, | coupling arm |
| 42, | side arm | 43, | hook |
| 44, | rear stopper | 45, | clipping arm |
| 46, | coupling hook | 47, | notch |
| 48, | step rabbet | 49, | side rib |
| 50, | external cover | 51, | protruding rib |
| 60, | casing | 221, | side rib |
| 241, | sloping edge | 271, | stopper |
| 411, | hook | 421, | protruding rib |

DETAILED DESCRIPTION OF THE PREFERRED EMBODIMENTS

Referring to FIGS. 1~14, the present invention relates to a USB connector structure and comprises a base 10, a main structure 20, a plural of pins 30 and a fixing structure 40, wherein a plural of conducting pads 11 are laid on top of base 10 and the main structure 20 is configured over the base 10. The main structure 20 is configured with pin rabbets 21 to have one side accommodate pins 30 respectively. And, the other side of pins 30, passing through the main structure 20, are configured as bending ends 31 which extend outside of the main structure 20 and provide electric contact with those conducting pads 11 laid on the base correspondingly. The fixing structure 40 is also configured over the base 10. And, the fixing structure 40 is formed as a whole body with the main structure 20 by firmly hooked and fastened with each other. The bottom side of the fixing structure 40 is further configured with a step rabbet 48 which provides a pushing effect and accommodates those pins 30 extended outside the main structure 20 to enable the curve part of each bending end 31 having a tight and better electric contact with those conducting pads 31 laid on the base 10 correspondingly.

Figure 4:
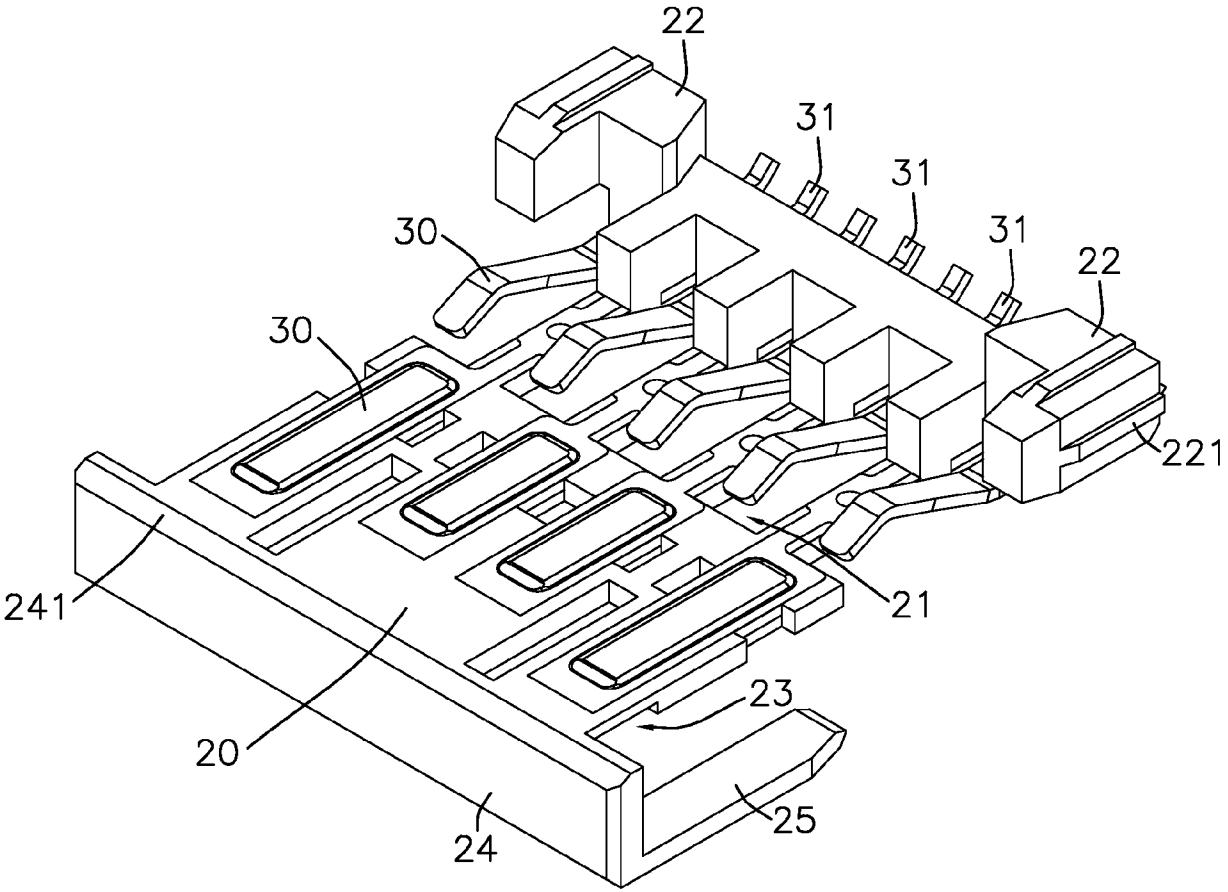
FIG. 4 illustrates a schematic combination of the base and pins related to the first embodiment of the present invention.
Figure 5:
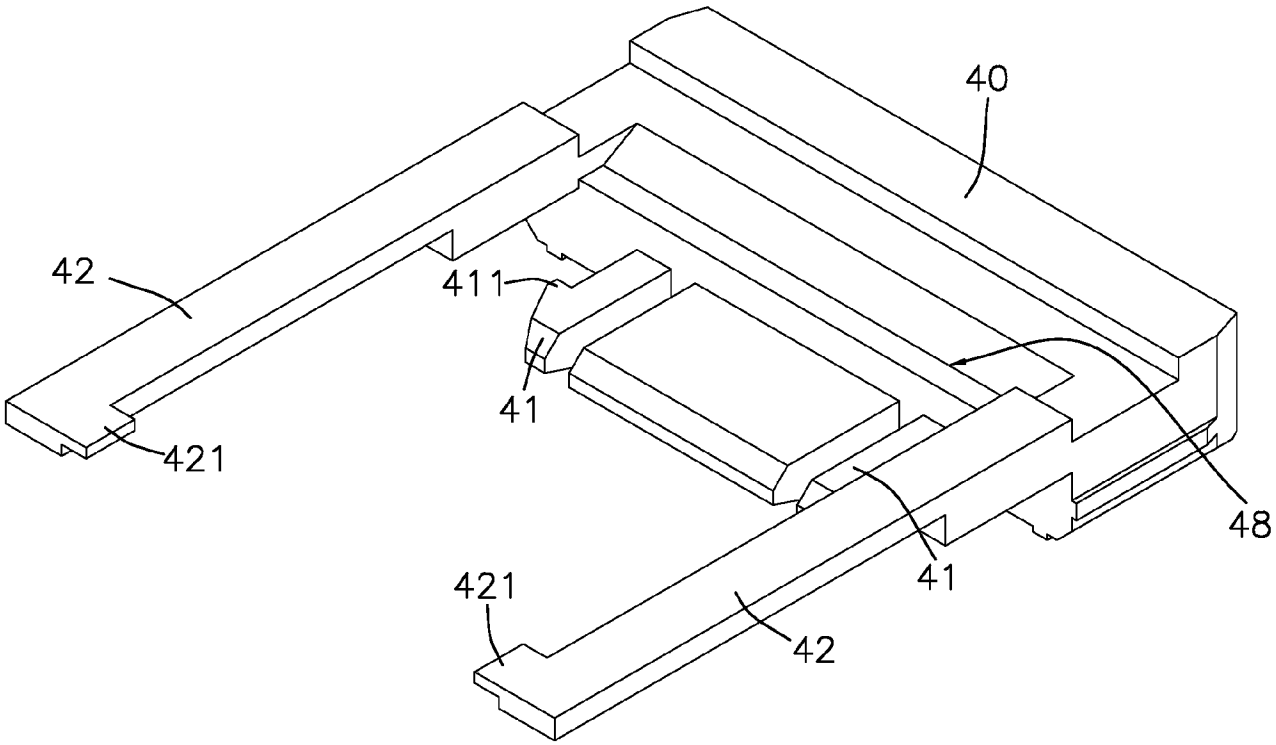
FIG. 5 illustrates another schematic bottom view of the fixing structure related to the present invention.
Figure 6:
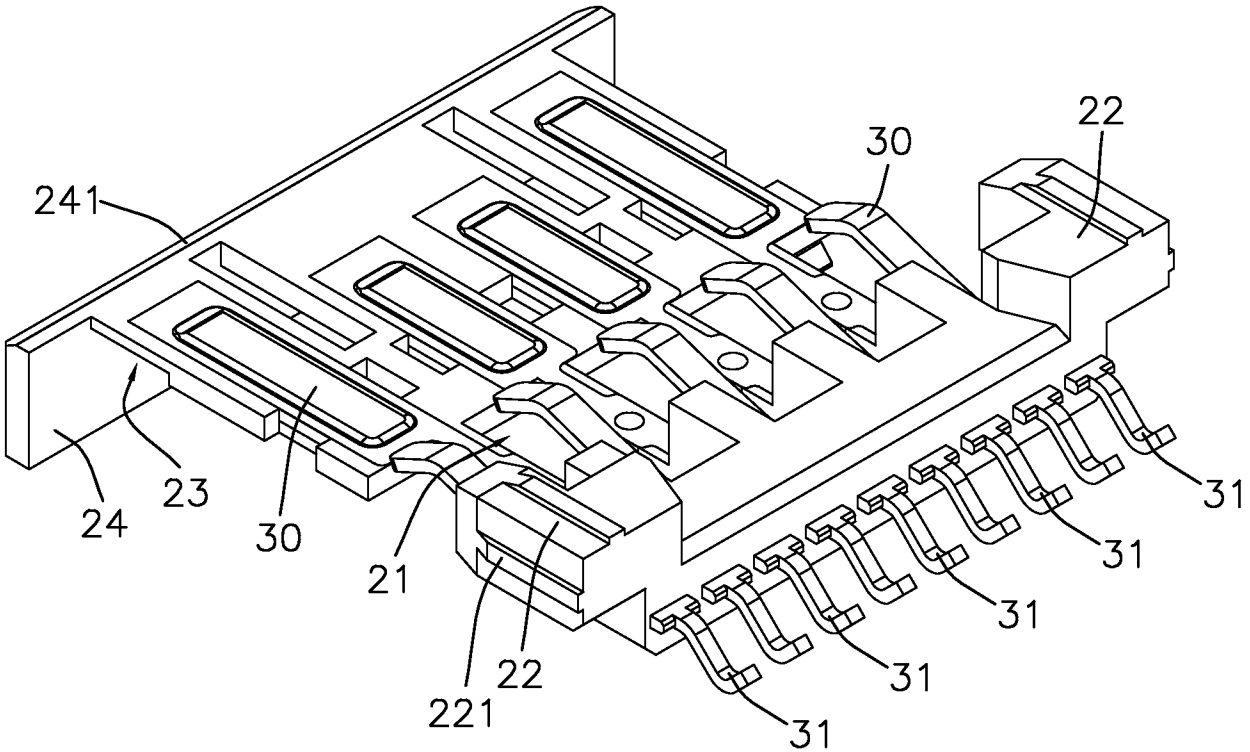
FIG. 6 illustrates a schematic combination of the base and pins related to the second embodiment of the present invention.
Figure 7:
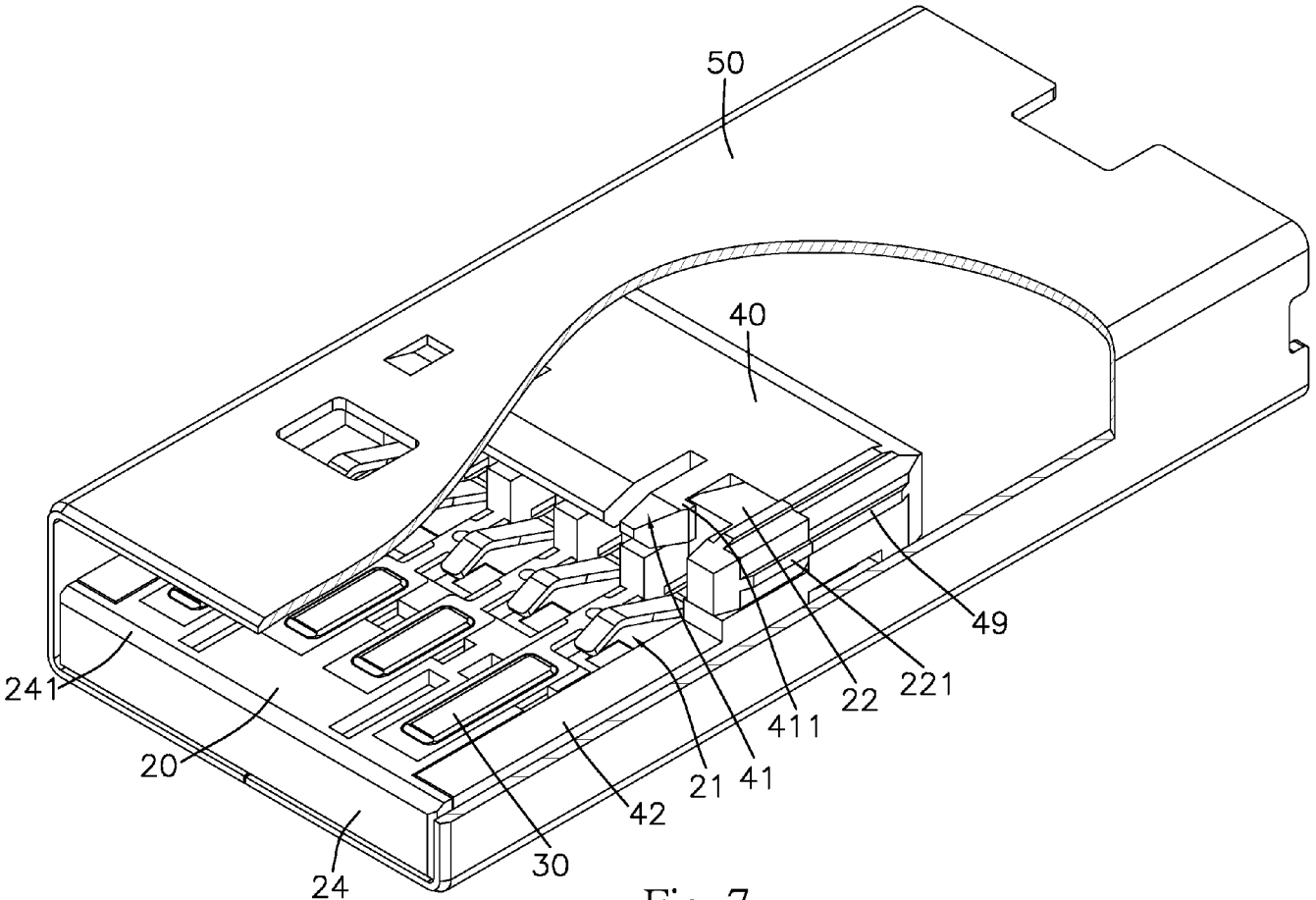
FIG. 7 illustrates a partial perspective view related to the external cover of the present invention.
Figure 8:
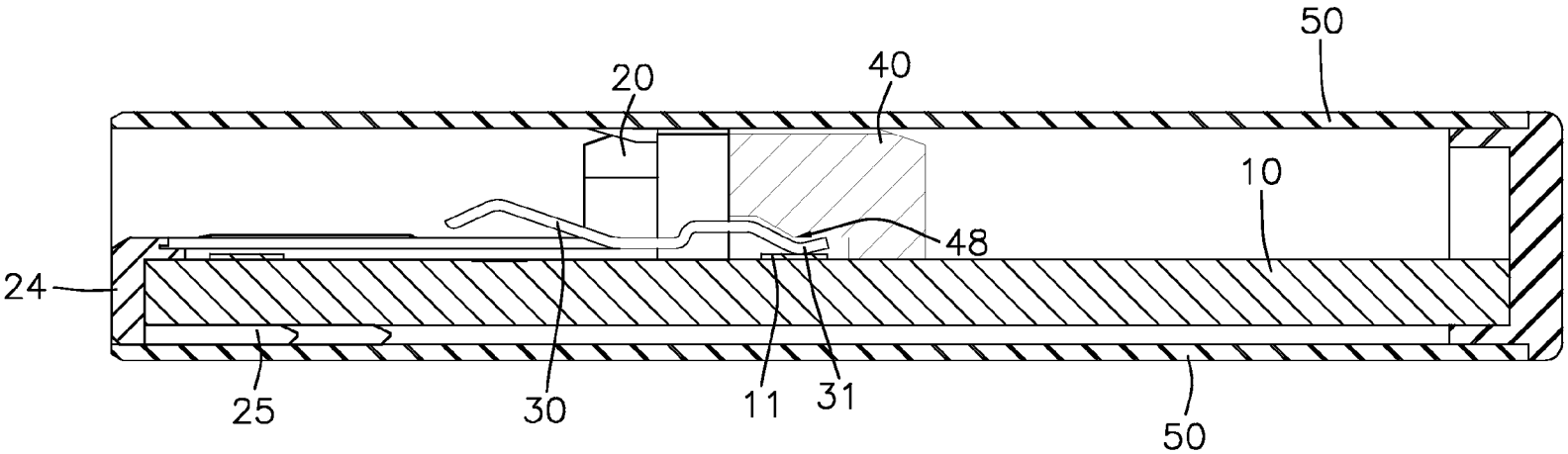
FIG. 8 illustrates a schematic cross-section view related to the external cover of the present invention.
Figure 9:
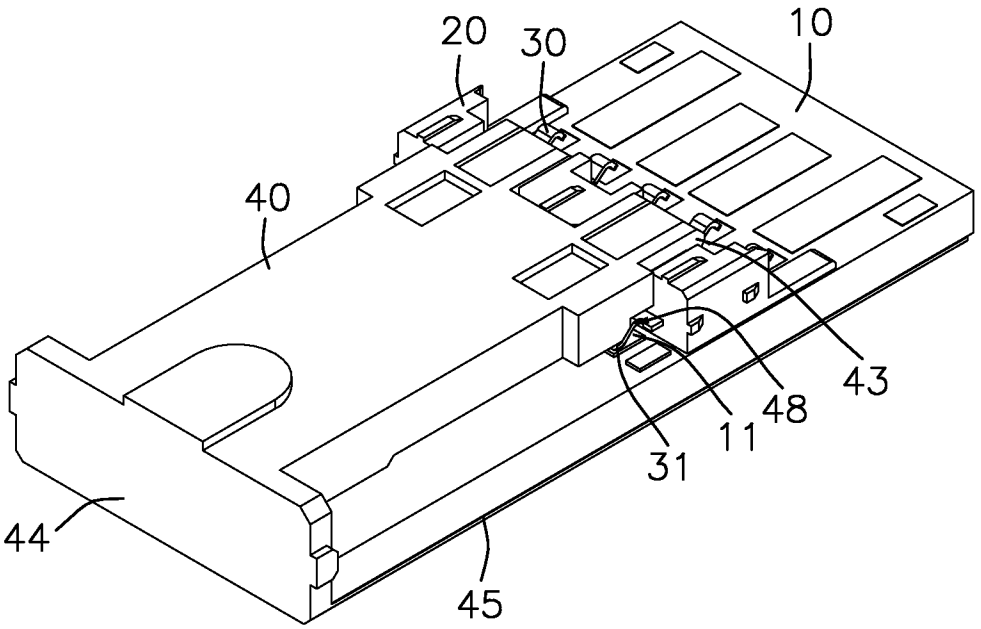
FIG. 9 illustrates a three-dimensional schematic view related to the second embodiment of the present invention.

Meanwhile, both corners of the main structure 20 toward the fixing structure 40 side are further configured with a holding block 22 formed as a L-shape structure (as shown in FIG. 4). Both holding blocks 22 are configured with side ribs 221 at top and side position. And, the middle part of the fixing structure 40 is both side configured with a coupling arm 41 respectively and the front end of the said coupling arm 41 is further configured as a hook 411 structure (as shown in FIG. 7) to firmly fasten and couple with each holding block 22 forming as a whole body over the base 10. Besides, both sides of the fixing structure 40 are forward extended as a step-like side arm 42 which is further configured with a protruding rib 421 located toward the inner side to fit with the side rabbets 23 configured at both sides of the main structure 20 near the bottom position of each pin 30. And, the front side of the main structure 20 is configured as a front stopper 24, with a sloping edge 241 at the upper end, to hold against the front end of base 10. Both lower corners are further extended backward as a clipping arm 25 respectively to have a tight clip-on connection with the front end of base 10.

Figure 10:
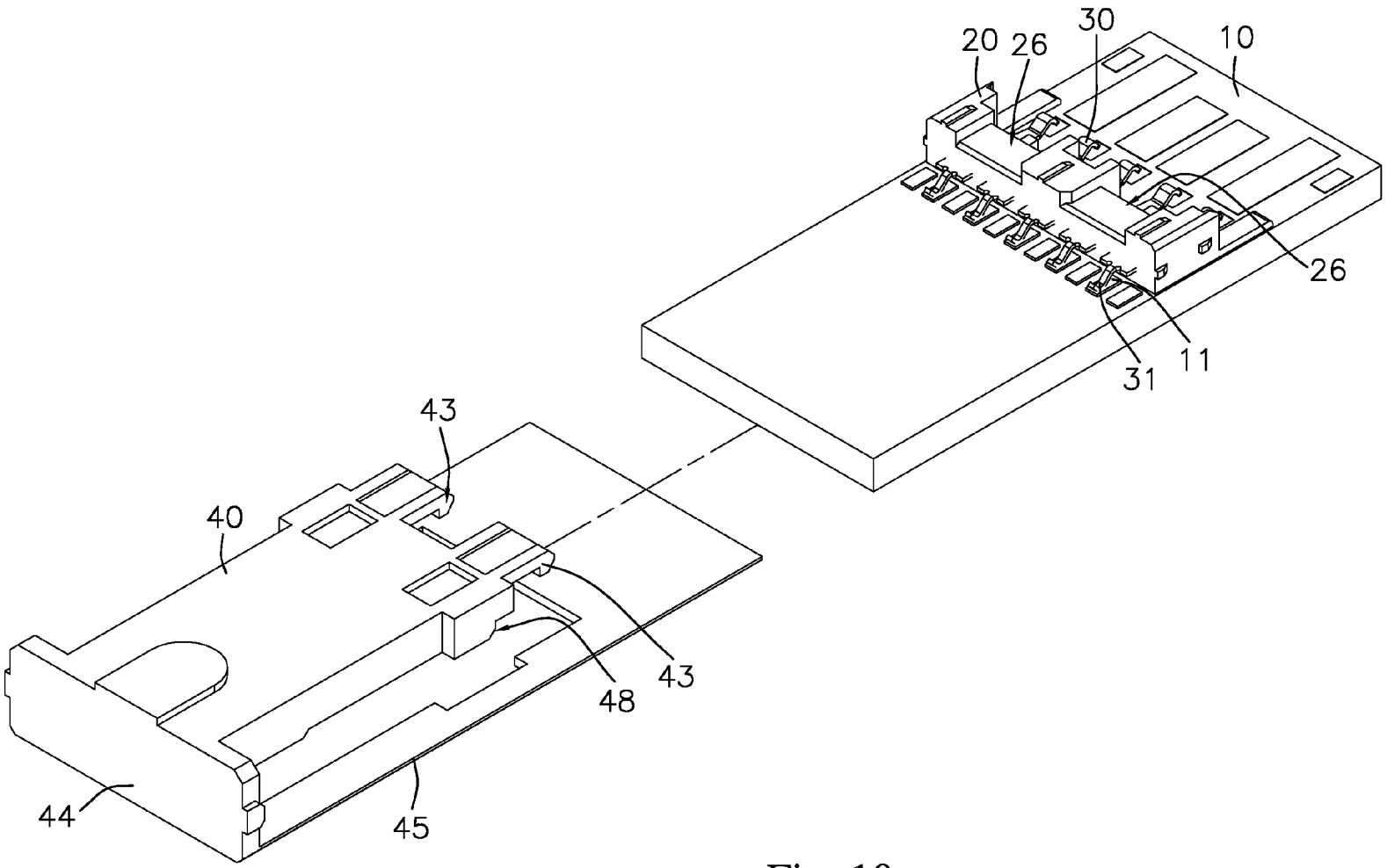
FIG. 10 illustrates a three-dimensional decomposition view of the second embodiment.
Figure 11:
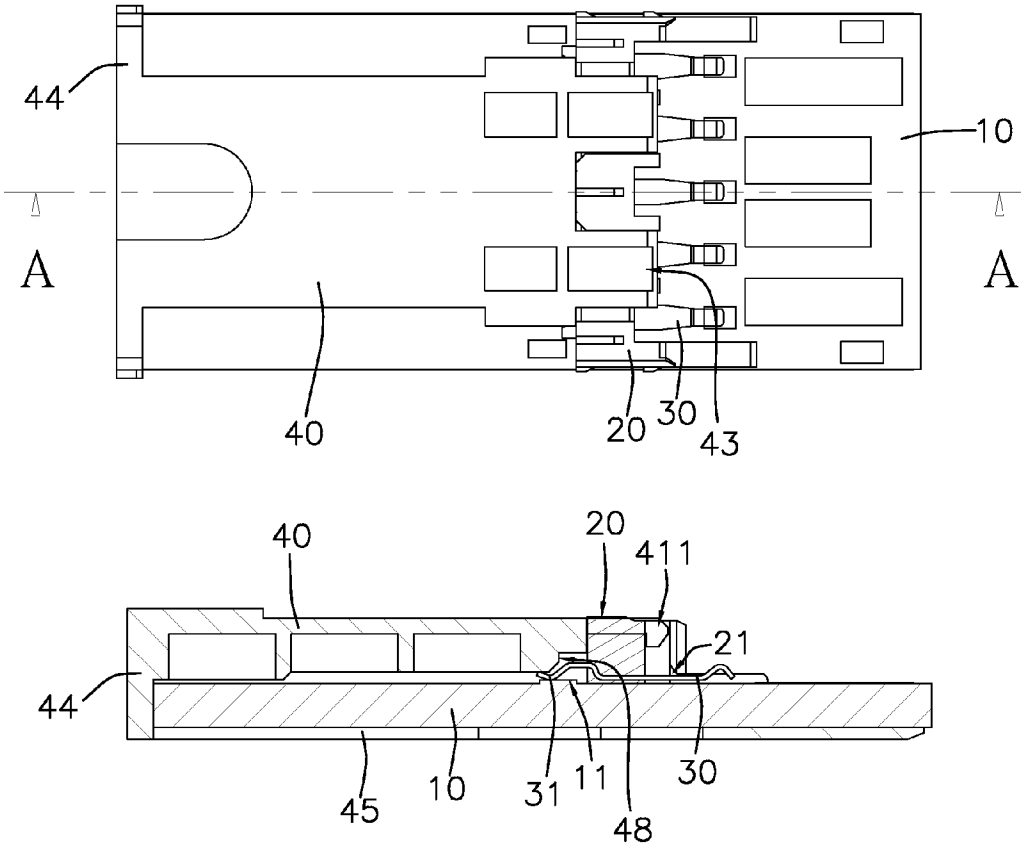
FIG. 11 illustrates an A-A schematic cross-section view of the second embodiment.
Figure 12:
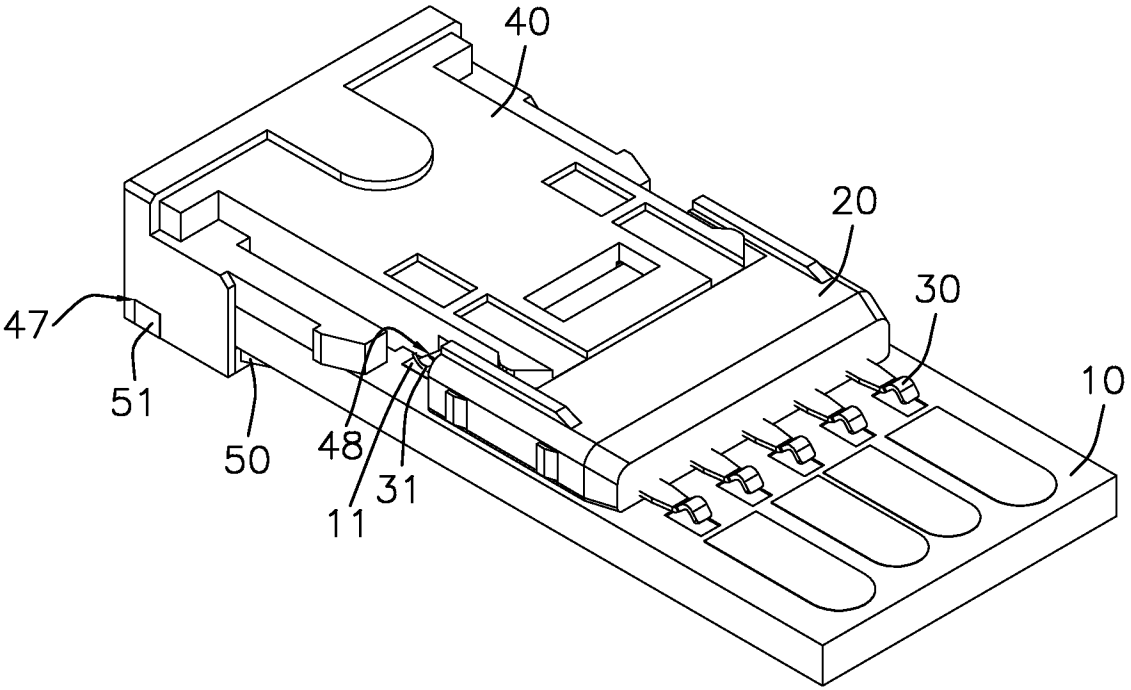
FIG. 12 illustrates a three-dimensional schematic view related to the third embodiment of the present invention.

Alternatively (as shown in FIG. 10), there is another embodiment for the main structure 20 and the fixing structure, wherein the main structure 20 is configured with notches 26 at the top position to fit those hooks 43 extended from the front of the fixing structure 40. And, this joint connection enables the fixing structure 40 to firmly fasten with the main structure 20. The back side of fixing structure 40 is configured as a rear stopper 44 to hold against the back end of base 10. Both lower sides of the fixing structure 40 are extended and configured with clipping arms respectively to have a tight clip-on connection with the base 10.

Figure 13:
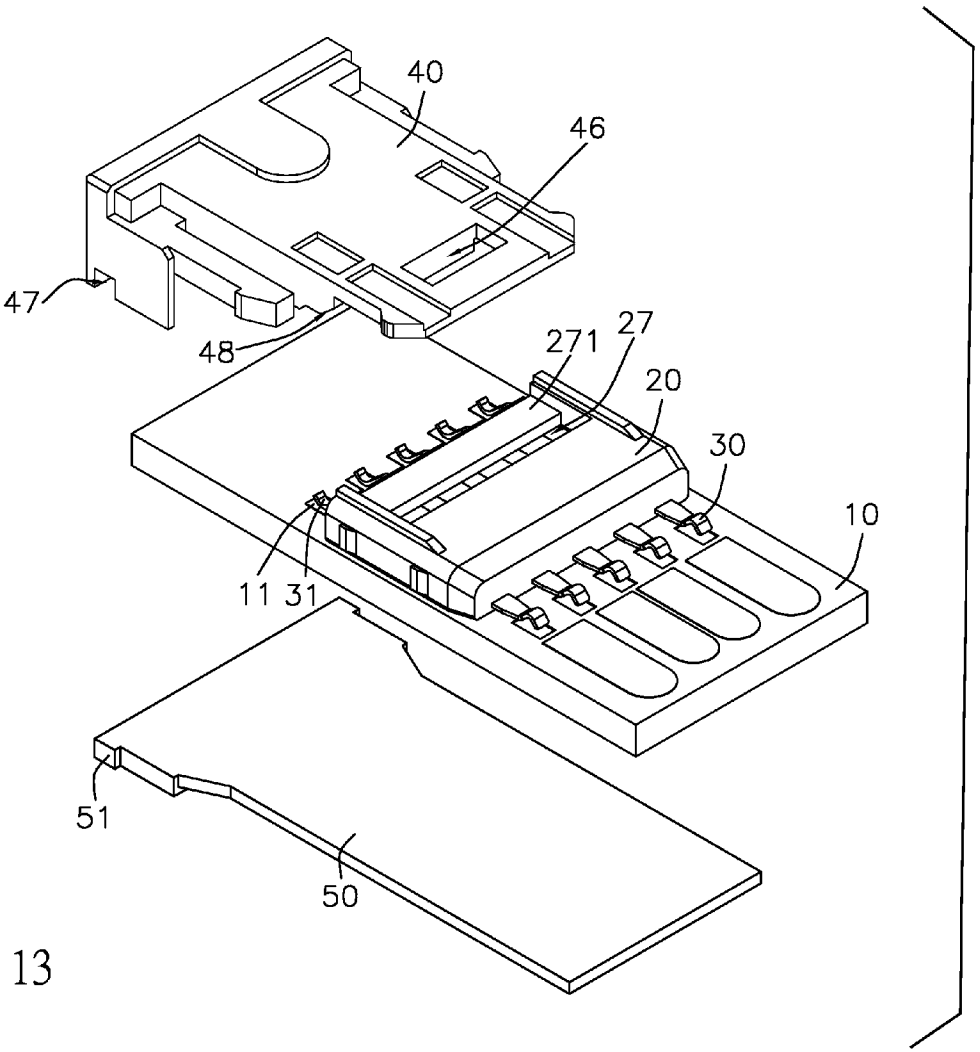
FIG. 13 illustrates a three-dimensional decomposition view of the third embodiment.
Figure 14:
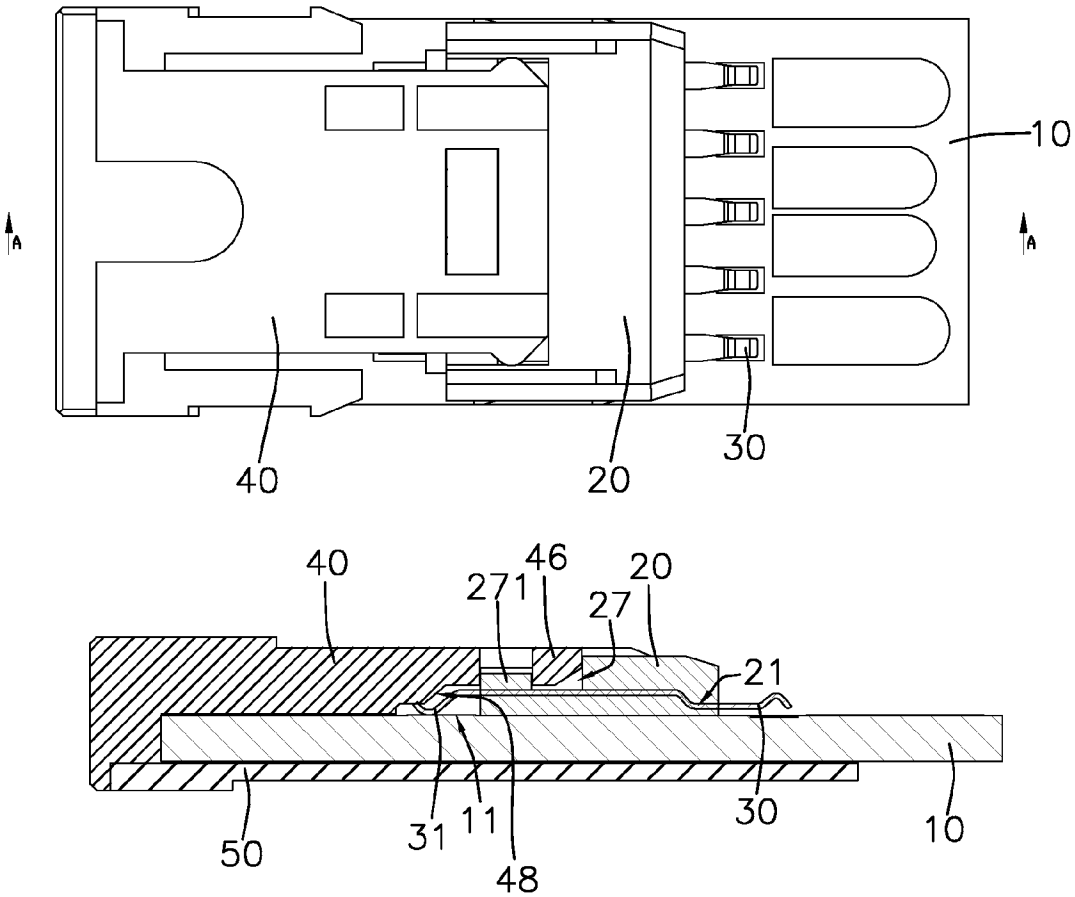
FIG. 14 illustrates an A-A schematic cross-section view of the third embodiment.

Furthermore, the top side of the main structure 20 is configured with a rabbet 27 (as shown in FIG. 13) over those pins penetrating through and a stopper 271 to fit the coupling hook 46 extended from the font bottom position of the fixing structure 40 to provide another embodiment for the joint connection of the fixing structure 40 and the main structure 20. Both rear corners are respectively configured with a notch 47 at the lower position to fit with an external cover 50, located at the lower side and formed with a protruding rib 51 both at the rear corner, and to offer a tight clip-on connection for the base 10 between the fixing structure 40 and the external cover 50. And, the lower inner side of the fixing structure 40 is configured as a step rabbet 48 to provide a pushing effect and accommodate those pins 30 extended outside the main structure to enable the curve part of each bending edge 11 having a tight and better electric contact with those conducting pads 31 laid on the base 10 correspondingly. Finally, the joint structure of the base 10, the main structure 20 and the fixing structure 40 are inserted into and close wrapped by a casing 50 (not shown) to form as a complete USB connector structure.

Please refer to the FIGS. 1~14, which shows schematic views related to the various embodiments of the present invention. The primary purpose is to provide a connecting method and structure free soldering procedure during the manufacturing process. Thus, the joint structure of the main structure 20 and the fixing structure 40 are firmly configured over the base 10. And, the present invention can be applied in different types of USB interface.

Of course, it is to be understood that the embodiments described herein are merely some illustrations related to the objects of the invention and that a wide variety of modifications thereto may be adopted without departing from the purpose and the scope of the present invention as set forth in the following claims.

What is claimed is:

1. A USB connector structure, comprises a base, wherein a plural of conducting pads are laid on the base correspondingly;

a main structure, which is configured over the base and is configured with pin rabbets;

a plural of pins, which have one side accommodated in pin rabbets respectively and the other side of those said pins are configured as bending ends which extend outside of the main structure; and a fixing structure, which is configured over the base and is formed as a whole body with the main structure, and the lower side of the fixing structure pushes the said plural pins to enable the curve part of each bending end electrically contacts with those conducting pads laid on the base correspondingly;

wherein both corners of the main structure toward the fixing structure side are further configured with a holding block formed as a L-shape structure, and the middle part of the fixing structure is both side configured with a coupling arm respectively and the front end of the said coupling arm is further configured as a hook structure to fasten and couple with each holding block;

wherein the front side of the main structure is configured as a front stopper with a sloping edge at its upper end to hold against the front end of base.

2. A USB connector structure according to claim 1, wherein both sides of the main structure near the bottom position of each pin are configured with side rabbets and both sides of the fixing structure are forward extended as a step-like side arms which is further configured with a protruding rib located toward the inner side to fit with the side rabbets.

3. A USB connector structure according to claim 1, wherein both lower corners are further extended backward as a clipping arm respectively to have a clip-on connection with the front end of base.

4. A USB connector structure according to claim 1, wherein the lower inner side of the fixing structure is configured as a step rabbet to push and accommodate those pins extended outside the main structure.

5. A USB connector structure according to claim 1, wherein the lower inner side of the fixing structure is configured as a step rabbet to push and accommodate those pins extended outside the main structure.

6. A USB connector structure according to claim 1, the joint structure of the base, the main structure and the fixing structure are inserted into and close wrapped by a casing.

7. A USB connector structure according to claim 1, wherein the main structure is configured with notches at the top position to fit those hooks extended from the front of the fixing structure, which is configured over the base and fasten with the main structure, and the back side of fixing structure is configured as a rear stopper to hold against the back end of base, and the fixing structure are extended and configured with clipping arms respectively to have a clip-on connection with the base.

8. A USB connector structure according to claim 7, wherein the lower inner side of the fixing structure is configured as a step rabbet to push and accommodate those pins extended outside the main structure.

9. A USB connector structure according to claim 1, the top side of the main structure is configured with a rabbet over those pins penetrating through and a stopper, located behind the rabbet, to fit the coupling hook extended from the front bottom position of the fixing structure to provide another connection of the fixing structure and the main structure, and both rear corners are respectively configured with a notch at the lower position to fit with an external cover, located at the lower side and formed with a protruding rib both at the rear corner, and to offer a clip-on connection for the base between the fixing structure and the external cover.

10. A USB connector structure according to claim 9, wherein the lower inner side of the fixing structure is configured as a step rabbet to push and accommodate those pins extended outside the main structure.

* * * * *